US005086920A

United States Patent [19]

Binienda

[11] Patent Number: 5,086,920

[45] Date of Patent: Feb. 11, 1992

[54] SHIPPING CONTAINER HAVING CURVED DIVIDER PANELS

[75] Inventor: Robert Binienda, Northville, Mich.

[73] Assignee: Erb Lumber Co., Birmingham, Mich.

[21] Appl. No.: 645,216

[22] Filed: Jan. 24, 1991

[51] Int. Cl.[5] ..... B65D 85/68

[52] U.S. Cl. ..... 206/335; 206/448; 206/589; 206/593; 211/41; 220/1.5; 220/507; 220/553; 410/32

[58] Field of Search ..... 206/448, 335, 583, 585, 206/589, 593, 592; 220/1.5, 529, 530, 533, 507, 553; 211/41, 13, 59.4; 410/43, 32

[56] References Cited

U.S. PATENT DOCUMENTS

| | | | |
|---|---|---|---|
| 1,642,562 | 9/1927 | Scohy | 410/32 |
| 2,112,028 | 3/1938 | Kirby | 211/41 X |
| 2,348,414 | 5/1944 | Pierce | 211/41 |
| 2,835,406 | 5/1958 | Dickerson | 220/553 X |
| 3,064,872 | 11/1962 | Skirow | 206/593 X |
| 3,279,514 | 10/1966 | Mintz | 220/507 |
| 3,834,349 | 9/1974 | Dretze et al. | 211/41 X |
| 4,613,263 | 9/1986 | James | 410/32 |
| 4,685,571 | 8/1987 | Hoss | 206/583 |
| 4,733,781 | 3/1988 | Gerlach | 211/41 |
| 4,735,320 | 4/1988 | Hoss | 206/583 |

*Primary Examiner*—Bryon P. Gehman

*Attorney, Agent, or Firm*—Reising, Ethington, Barnard, Perry & Milton

[57] ABSTRACT

The invention relates to a shipping container utilizing flexible divider panels each formed with one or more flaps attachable to a surrounding frame structure in a way to vary the panel curvature to accommodate variously contoured parts for shipping.

5 Claims, 3 Drawing Sheets

SHIPPING CONTAINER HAVING CURVED DIVIDER PANELS

BACKGROUND OF THE INVENTION

The present invention relates to a shipping container utilizing a plurality of longitudinally spaced panels secured within a rectangular frame structure to provide adjacent pockets to receive parts in non-contacting relationship with each other. For that case where the parts to be shipped in the container such as, for example, stamped door panels, have a curvature, the panels may be mounted in such a way as to provide a curvature corresponding to that of the part to be shipped. More specifically the divider panels are formed of a flexible material and includes at least one flap adapted to be secured to an adjacent frame wall and wherein the longitudinal displacement of said flap relative to the opposite edge of each panel determines the degree of curvature of the panel.

More specifically, the invention includes divider panels having upper and lower flaps respectively secured to upper and lower frame walls with the lateral displacement of the flaps with respect to each other determining the curvature of the panel when secured to the frame.

PRIOR ART

The following patents are the closest prior art of which applicant is aware:

2,953,253: Henderson et al 4,899,880: Carter 4,921,100: Krause

While the foregoing patents relate to containers for shipping a plurality of similarly shaped parts, none utilizes flexible divider panels adapted to be secured to a surrounding frame structure in such a way as to vary the curvature of the panels to provide a plurality of aligned pockets the curvature of which can be varied in accordance with the longitudinal displacement between the upper and lower edges of each panel.

SUMMARY OF THE INVENTION

It is the object of the present invention to provide a shipping container comprising a generally rectangular frame having at least one open side, a plurality of divider panels mounted within said frame in generally equally spaced relationship with each other whereby adjacent panels form a pocket for receiving a part to be shipped within the container in non-contacting relationship to other parts. More specifically, the frame includes vertically spaced top and bottom walls joined by longitudinally spaced end walls. Each divider panel is of the same general rectangular shape as the surrounding frame, is formed of a flexible material and the height of each panel is greater than the interior height of the frame. The top and bottom edges of each panel are adapted to be respectively secured to the top and bottom frame walls in such a way as to impart a curvature to each panel and with the curvature of each panel being substantially identical so as to provide a plurality of substantially identically shaped pockets.

The means by which the above stated object and the advantages of the invention are realized will be clearly understood from the following description of a preferred embodiment thereof selected for the purposes of illustration, having reference to the drawings, wherein:

DESCRIPTION OF THE PREFERRED EMBODIMENT

Figure 1:
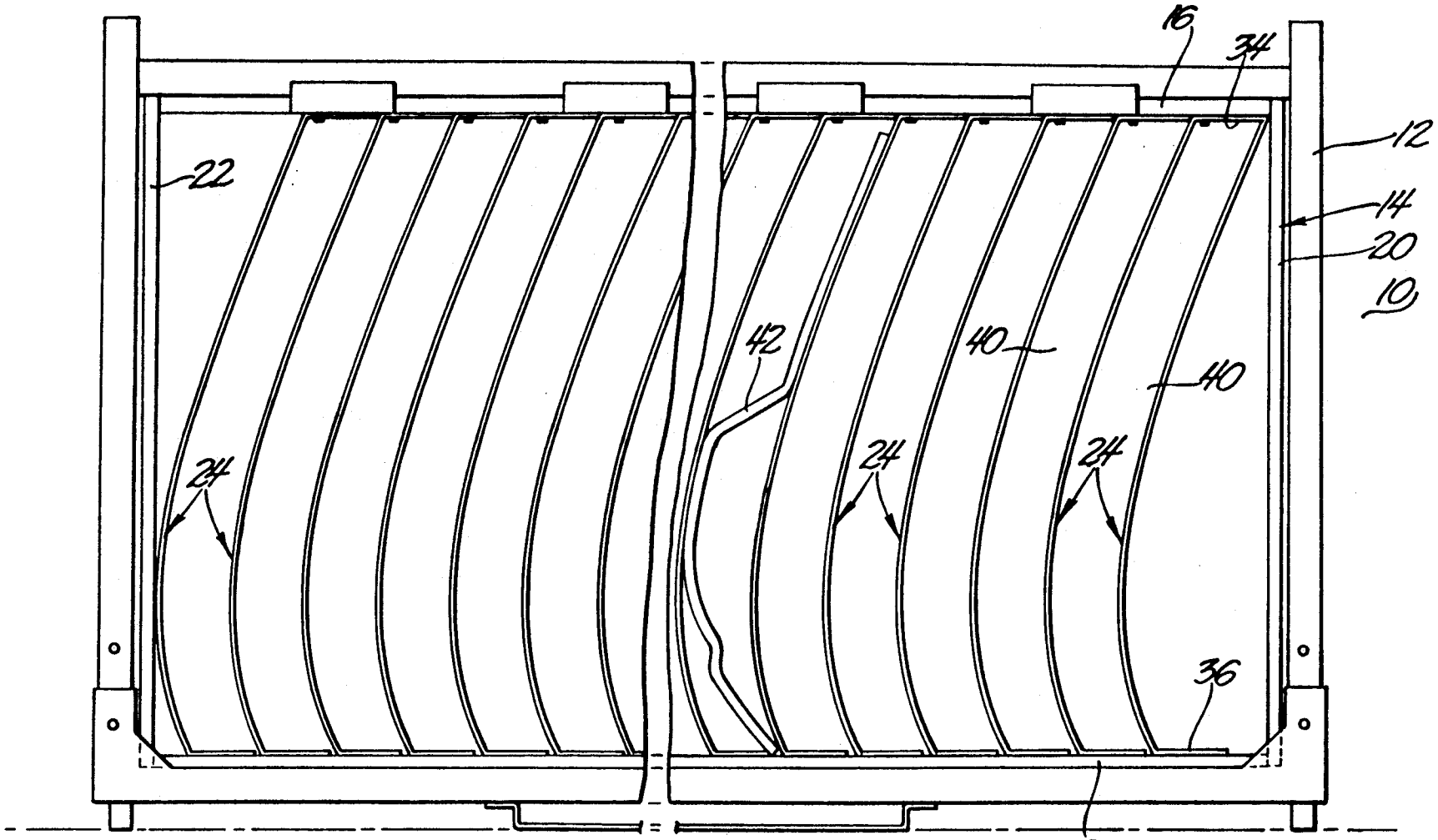
FIG. 1 is a side elevation of shipping container of the subject invention.

Referring particularly to FIG. 1, a shipping container is indicated generally at 10 and includes an open metal outer frame 12 and an inner wooden liner or frame 14. More specifically, the wooden liner consists of vertically spaced top and bottom walls 16 and 18 suitably secured to longitudinally spaced end walls 20 and 22. The outer metal frame work 12 provides the main structural strength for the container while the inner wooden frame provides the structure to which a plurality of panel dividers 24 are secured.

Panels 24 are formed of a suitable high strength plastic material such as a high density polyolefin. The thickness of the panels is such that they are flexible and, for example, a thickness of 0.125 inch is found to be very satisfactory. Panels 24 are of a rectangular shape corresponding to the general interior shape of the inner frame 14. The depth of each panel would be substantially the same as the depth of the interior wooden frame. However, the vertical dimension or height of each panel is greater than the interior height of the wooden frame. This greater panel height as compared to the vertical height of the internal wooden frame enables the panels to be mounted in such a way as to vary the curvature of the panels.

Figure 3:
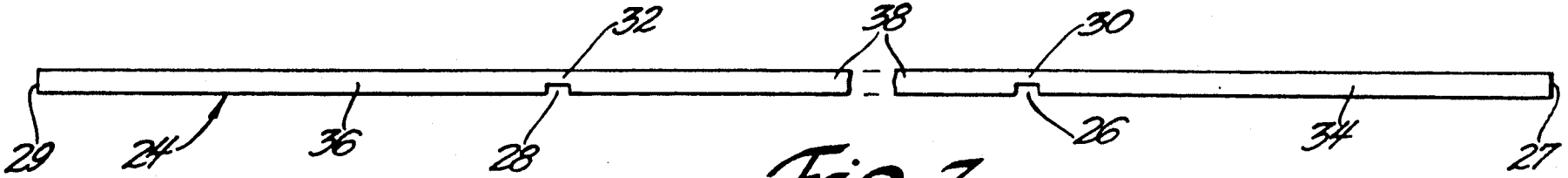
FIG. 3 is an end view of an unmounted divider panel.

As seen in FIG. 3, each unmounted panel 24 is formed with a pair of longitudinal grooves 26 and 28 formed proximate the upper and lower edges 27 and 29 of the panel. The grooves are parallel to the upper and lower panel edges and extend throughout the width of the panel. The grooves 26 and 28 are sufficiently deep, approximately one half the panel thickness, as to form thin panel wall sections 30 and 32 and thereby define end flaps 34 and 36 which are adapted to be bent relative to the main intermediate section 38 of the panel.

Figure 4:
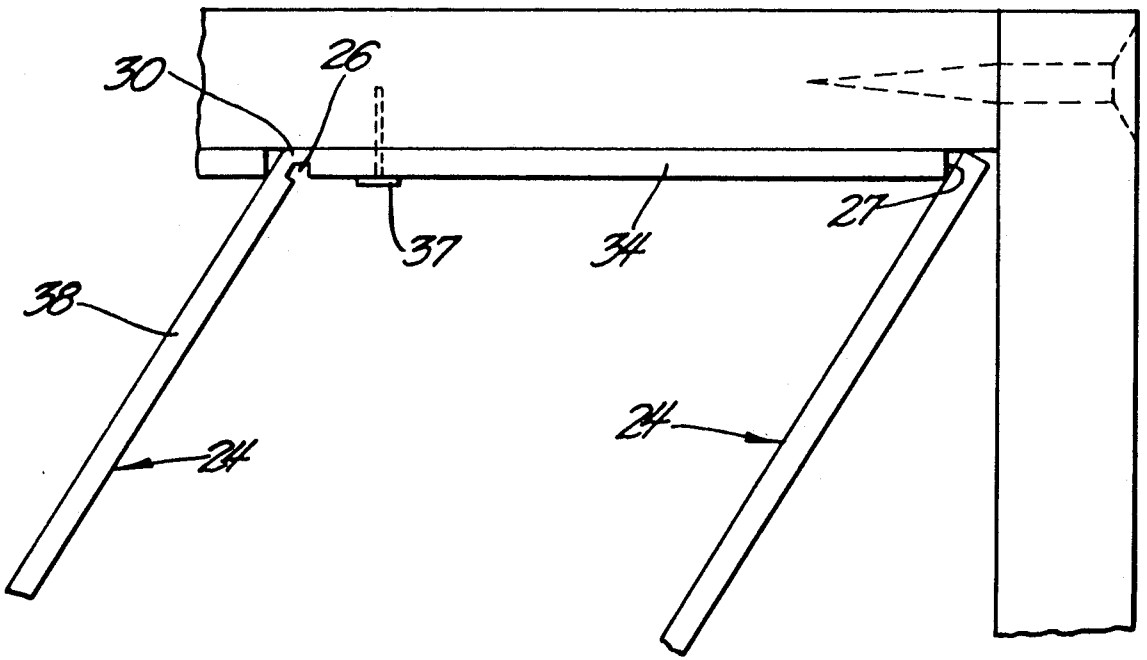
FIG. 4 is a partial enlargement of a corner of the inner container frame as indicated in the circled section of FIG. 2.

Referring particularly to FIG. 4 of the drawings, it will be noted that the panel flaps are adapted to be bent so as to extend generally horizontally and in any case, so as to be parallel to the adjacent upper and lower frame walls 16 and 18. The upper and lower flaps 34 and 36 are adapted respectively to be secured to the adjacent frame wall structure through staples 37 or other suitable fasteners.

Figure 2:
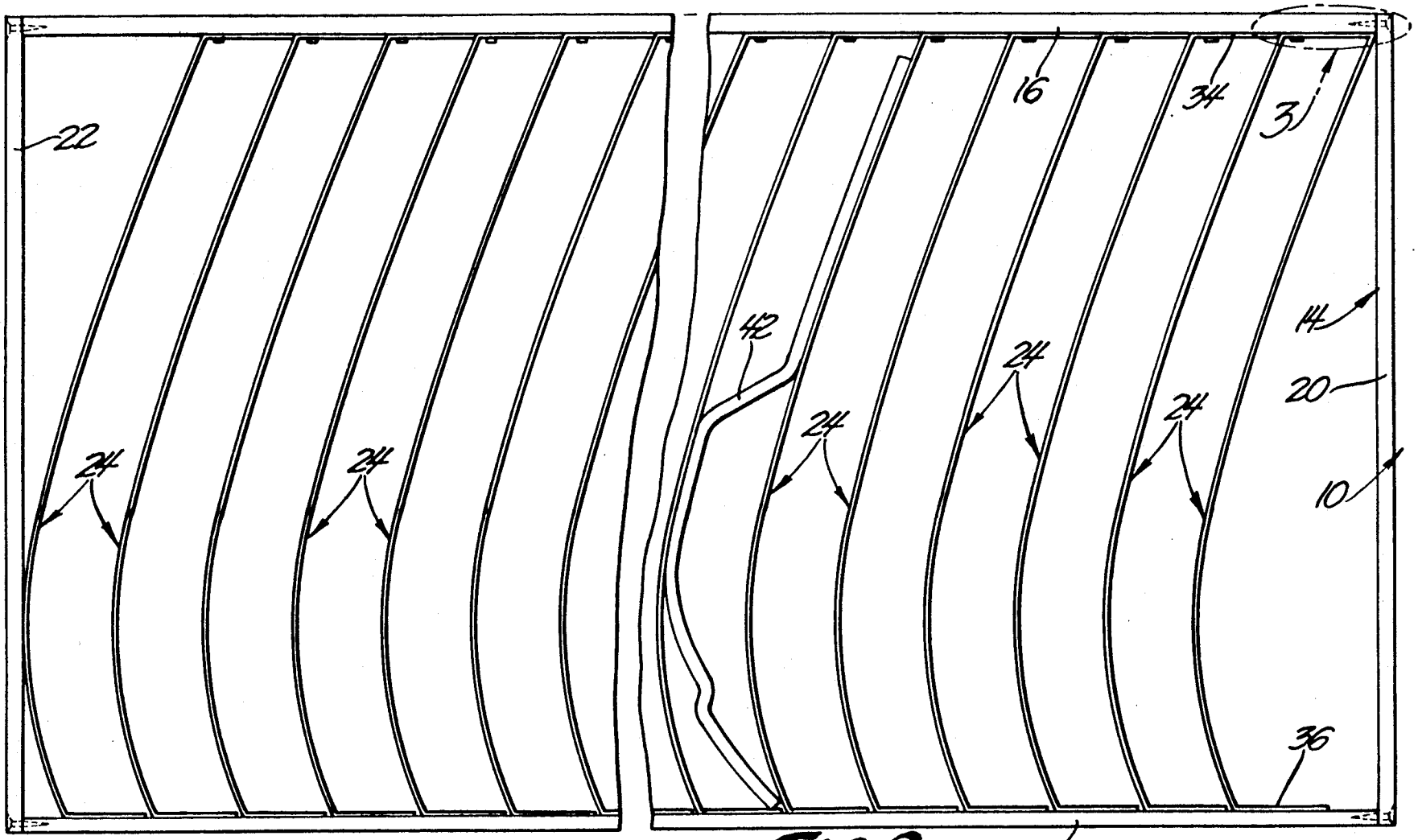
FIG. 2 is a slightly enlarged side view of the inner container frame with mounted divider panels.

The manner in which the flaps and thus panels are secured to the adjacent wooden frame structure will now be discussed and particularly as it relates to varying the curvature of each panel. It will first be noted that when installed and secured to the wooden frame structure 14, the flaps are in horizontally abutting relationship to adjacent panels and thus their longitudinal dimensions determines the distance between the panels and thereby the longitudinal dimension of the pockets 40 defined by adjacent panels. In assembling the container, the panels are serially installed beginning at one end with the first panel being installed and thereafter subsequent panels being installed and secured one after the other. Depending on the contour of the part to be shipped, for instance a curved vehicle door side panel 42, the manner in which the panels 24 are assembled can be varied. As seen in the embodiment of FIGS. 2 and 4, the panels are secured in such a way as to give a predetermined curvature to each panel. The curvature is varied in the following way. First, one of the flaps, either top or bottom, is first secured to the adjacent wooden frame wall. With this flap secure, the other flap is displaced longitudinally relative to the first secured flap to create a predetermined curvature to the panel. By way of example, the maximum curvature would be achieved if the grooves of each panel were vertically aligned. As the flaps and hence the grooves of each panel become more laterally displaced relative to each other, the curvature of the panel will decrease progressing from vertical alignment, with maximum curvature, to lateral displacement wherein the panels while slanted could have no curvature. In this way, the panels can be secured either to accommodate straight or flat parts to those having a predetermined curvature such as the door panel 42 shown in FIG. 1.

While the invention has been illustrated utilizing top and bottom flaps, it would also be possible to utilize a single flap. For example, lateral slots could be cut in the top or bottom wall to receive one end of the panel with the opposite end of the panel having a flap. Thus, one end of the panel can be inserted into the wooden frame slot while the other end of the panel and its associated flap could be adjusted longitudinally and subsequently secured to the associated wooden frame wall to provide the appropriate panel curvature.

It is also to be noted, as best seen in FIG. 4, that the last to be assembled panel would, for example, have its upper flap removed or bent vertically downwardly so as not to interfere with the associated vertical end wall of the wooden frame.

Other modifications of the invention are comprehended within the scope of the hereinafter appended claims.

What is claimed is:

1. A shipping container comprising a rectangular frame (14) having at least one open side, a plurality of divider panels (24) mounted within said frame in generally equally spaced relationship with each other whereby adjacent panels form a pocket (40) for receiving a part to be shipped within the container in non-contacting relationship to other parts, said rectangular frame including vertically spaced top and bottom walls (16, 18) joined at their respective ends by longitudinally spaced and normally disposed end walls (20, 22), each panel having a rectangular shape and being formed of a flexible material, the vertical dimension of each panel being greater than the interior height of the frame as defined by the distance between the vertically spaced top and bottom walls, each panel having top and bottom edges respectively secured to the top and bottom walls of said frame so as to impart a curvature to the panel, the curvature of each panel being substantially identical so as to provide a plurality of substantially identically shaped pockets.

2. A shipping container comprising a rectangular frame (14) having at least one open side, a plurality of divider panels (24) mounted within said frame in generally equally spaced relationship with each other whereby adjacent panels form a pocket for receiving a part to be shipped within the container in non-contacting relationship to other parts, said frame including vertically spaced planar top and bottom frame walls (16, 18) joined at their respective ends by longitudinally spaced and normally exposed end walls (20, 22), each panel having a rectangular shape and being formed of a flexible material, the vertical dimension of each panel being greater than the interior height of the frame as defined by the distance between the top and bottom walls, each panel having top and bottom edges, an upper transverse groove (26) formed in each panel parallel to and proximately vertically spaced from said top edge so as to define an upper planar flap (34), a lower transverse groove (28) formed in each panel parallel and proximately vertically spaced from said bottom edge so as to define a lower planar flap (36), each groove being sufficiently deep to form a thin panel wall section (30 or 32) to enable each flap to bend about its respective thin panel wall section, said flaps being respectively secured to the top and bottom frame walls so as to impart a curvature to each panel.

3. A shipping container as set forth in claim 2 wherein the upper planar flap and the lower planar flap (34 or 36) of each panel are of substantially the same shape and size and are coplanar with the other upper and lower planar flaps, respectively, when secured to the walls of said frame.

4. A shipping container as set forth in claim 2 wherein each transverse groove (26, 28) is of substantially the same size and shape, the upper and lower flaps being respectively secured to the top and bottom frame walls, the longitudinal displacement between each pair of transverse grooves when secured to the respective top and bottom frame walls determining the curvature of each panel.

5. A shipping container comprising a rectangular frame (14) having at least one open side, a plurality of divider panels (24) mounted within said frame in generally equally spaced relationship with each other whereby adjacent panels form a pocket (40) for receiving a part to be shipped within the container in non-contacting relationship to other parts, said frame including vertically spaced planar top and bottom frame walls (16, 18) joined at a pair of opposite end by longitudinally spaced end walls (20, 22), each panel having a rectangular shape and being formed of a flexible material, each panel having top and bottom panel edges, a pair of transverse grooves (26, 28) formed in each panel parallel to and respectively proximately vertically spaced from said top and bottom panel edges so as to define upper and lower planar flaps (34, 36), each groove being sufficiently deep to form thin panel wall sections (30, 32) to enable each flap to bend about the adjacent wall section, said upper and lower planar flaps being respectively secured to the top and bottom walls, the respective upper and lower planar flaps being respectively coplanar with the other upper and lower planar flaps and adapted to abut against an adjacent coplanar flap and to thereby determine the distance between adjacent panels.

* * * * *